United States Patent [19]

Kaneta

[11] Patent Number: 4,648,371

[45] Date of Patent: Mar. 10, 1987

[54] METHOD OF CONTROLLING A FUEL INJECTION APPARATUS

[75] Inventor: Keisuke Kaneta, Hamamatsu, Japan

[73] Assignee: Suzuki Jidosha Kogyo Kabushiki Kaisha, Shizuoka, Japan

[21] Appl. No.: 808,412

[22] Filed: Dec. 12, 1985

[30] Foreign Application Priority Data

Dec. 28, 1984 [JP] Japan ..... 59-274941

[51] Int. Cl.[4] ..... F02D 41/10

[52] U.S. Cl. ..... 123/492; 123/478

[58] Field of Search ..... 123/492, 478, 480, 493

[56] References Cited

U.S. PATENT DOCUMENTS 3,926,153 12/1975 Reddy ..... 123/492

FOREIGN PATENT DOCUMENTS 50-136523 10/1975 Japan .
53-14232 2/1978 Japan .
58-143139 8/1983 Japan .
58-150045 9/1983 Japan ..... 123/492
59-28028 2/1984 Japan .
59-68530 4/1984 Japan .
59-90768 5/1984 Japan ..... 123/492

*Primary Examiner*—Andrew M. Dolinar
*Attorney, Agent, or Firm*—Flynn, Thiel, Boutell & Tanis

[57] ABSTRACT

A fuel injection control method for electronically controlling an amount of fuel injected includes the step of performing asynchronous fuel injection control to increase the amount of fuel injected when the following three conditions are satisfied: (1) the engine has shifted from an idling operating state to a running operating state, (2) the rotating speed of the engine is higher than a predetermined speed, and (3) the velocity of the vehicle is higher than a predetermined velocity. A switch from the idling operating state to the running operating state is detected by checking whether an idle contact of a throttle sensor is switched from ON to OFF. The rotating speed is detected at the ignition coil. The velocity of the vehicle is detected using the vehicle velocity sensor.

3 Claims, 4 Drawing Figures

METHOD OF CONTROLLING A FUEL INJECTION APPARATUS

FIELD OF THE INVENTION

The present invention relates to a fuel injection control method and, more particularly, to a fuel injection control method for an internal combustion engine in which the fuel injection method in a transient state of the engine is changed to prevent the occurrence of inconvenience such as shock or the like and to improve the operating performance.

BACKGROUND OF THE INVENTION

Recently, internal combustion engines for motor vehicles have frequently been equipped with electronically controlled fuel injection arrangements to solve problems regarding harmful components in the exhaust gas, efficiency of fuel consumption and the like. Such an electronically controlled fuel injection arrangement is designed in a manner so that the changes in the operating state of the engine with respect to a load, a rotating speed of the engine, a temperature of cooling water or coolant, the amount of intake air and the like are detected as electrical signals which are used as inputs to the fuel injection apparatus, and then this apparatus outputs a fuel injection signal to control the injector. During a transient state at the start of a vehicle or the like, fuel injection is controlled independently of the fundamental injection, namely asynchronously with respect to the fundamental fuel injection, in order to improve a response speed in the transient state.

Examples of the asynchronous fuel injection control methods have been disclosed in the Official Gazettes of Japanese Patent Unexamined Publication Nos. 68530/1984, 14232/1978, and 136523/1975. The asynchronous fuel injection control method as shown in the flowchart of FIG. 1 has also been known.

The above-mentioned conventional fuel injection control method will now be described with reference to the flowchart shown in FIG. 1. In step 200, the engine is started. In step 202, a check is made to see if the idle contact of the throttle sensor has switched from ON to OFF. If not, fuel injection control in the ordinary manner is performed (in step 208). On the other hand, if it is determined in step 202 that the idle contact has switched off, a comparison is made at 204 to see if the rotating speed ($N_e$) of the engine is higher than a predetermined rotating speed ($N_u$). If the speed ($N_e$) is found to be equal to or less than the speed ($N_u$) in step 204, fuel injection control in the ordinary manner is performed (in step 208). On the other hand, if it is determined in step 204 that the actual speed ($N_e$) is above the predetermined speed ($N_u$), asynchronous fuel injection control to increase the amount of fuel injected is executed in step 206 in order to produce a rich air-fuel mixture and improve the response speed in the transient state.

However, in such a conventional electronically controlled fuel injection apparatus, the execution of the asynchronous correction to increase the amount of fuel injected meets only the particular situation corresponding to a part of the operating state of the engine. Therefore, in small-sized and light-weight vehicles, vehicles having a small cylinder capacity, or the like, the explosion pressure is increased to a higher level than needed, due to the rich air-fuel mixture, which causes problems such as large shocks which momentarily occur in the vehicle and cause the driver to have an unpleasant feeling. Also, when the accelerator is frequently pressed little by little or the like, there occur problems such as the engine condition becoming bad and the engine stopping, or the spark plug becoming dirty and being damaged. Further, front wheel drive vehicles are likely to be influenced due to a small shock as well. Therefore, there is need for a fuel injection control method which does not exert an adverse influence on the running state of vehicles such as small-sized and light-weight vehicles, vehicles having a small cylinder capacity, front wheel drive vehicles, or the like.

SUMMARY OF THE INVENTION

It is an object of the present invention to provide a fuel injection control method in which, when the control method is applied to motor vehicles such as small-sized and light-weight vehicles, vehicles having a small cylinder capacity, front wheel drive vehicles, or the like, problems such as shock and the like in the transient state at the start of the vehicle, or the like are avoided, the operating performance is improved, and fouling and damage to the spark plug can be prevented as much as possible.

This object is accomplished according to the present invention by providing a fuel injection control method for electronically controlling the amount of fuel injected, in which asynchronous fuel injection is performed in the case where at least the following three conditions are satisfied: (1) the engine has shifted from the idling operating state to the running operating state; (2) the rotating speed of the engine is higher than a predetermined rotating speed; and (3) the velocity of the vehicle is higher than a predetermined velocity. Thus, according to the invention, asynchronous fuel injection control is not performed in the very low velocity range where the velocity of the vehicle is lower than the predetermined velocity, but instead fuel injection control in the ordinary manner is carried out. Therefore, in small-sized and light-weight vehicles, vehicles having a small cylinder capacity, or front wheel drive vehicles, problems such as shock at the start of the vehicle or the like can be prevented, and the operating performance can be improved.

BRIEF DESCRIPTION OF THE DRAWINGS

One embodiment of the present invention will now be described in detail hereinafter with reference to the drawings, in which.

DESCRIPTION OF THE PREFERRED EMBODIMENT

Figure 1:
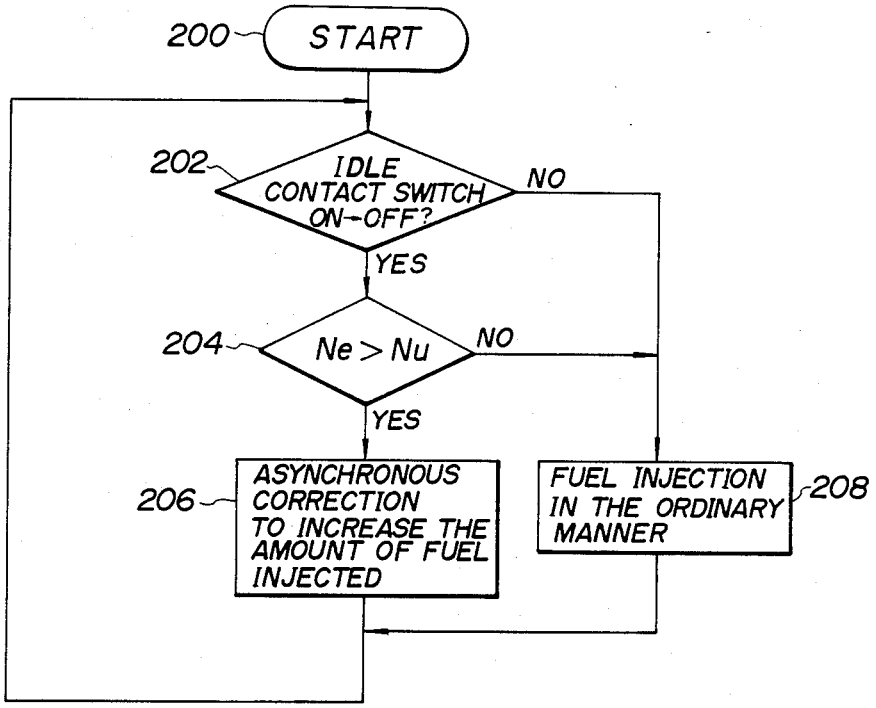
FIG. 1 PRIOR ART
FIG. 1 is a flowchart showing a conventional fuel injection control method.
Figure 2:
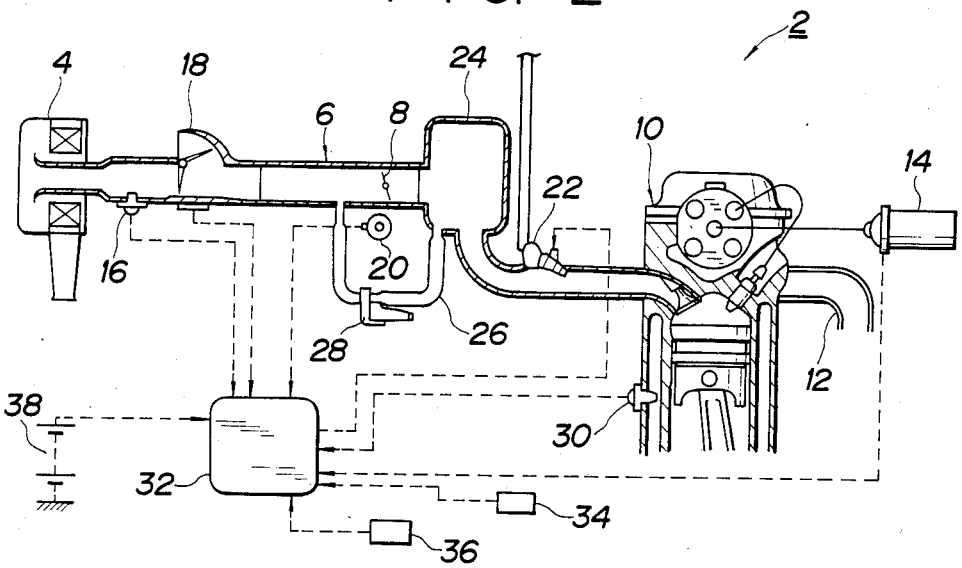
FIG. 2 is a diagrammatic view of a fuel injection control apparatus embodying the present invention.
Figure 3:
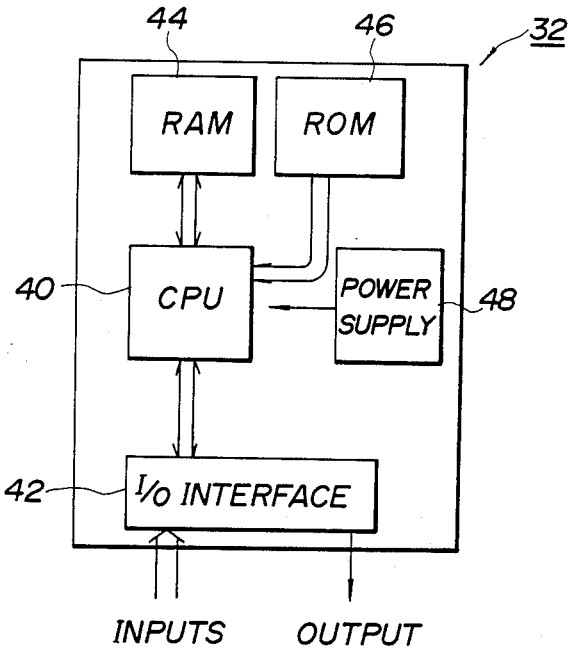
FIG. 3 is a schematic diagram of a control section which is a component of the apparatus of FIG. 2.
Figure 4:
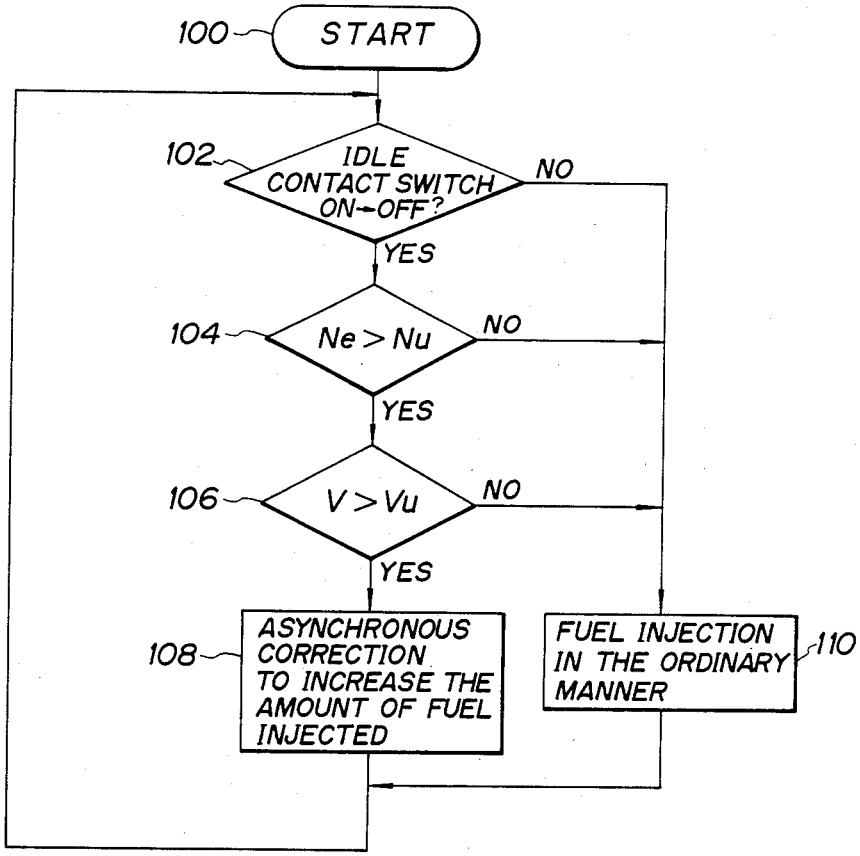
FIG. 4 is a flowchart showing the operation of the apparatus of FIG. 2.

FIGS. 2 to 4 show an embodiment of the invention. Referring to FIG. 2, there is shown a fuel injection control apparatus 2 which embodies the present invention, wherein reference numeral 4 denotes an air cleaner; 6 denotes an intake passage; 8 denotes a throttle valve; 10 denotes an internal combustion engine; 12 denotes an exhaust passage; and 14 denotes an ignition device. An intake air temperature sensor 16 to detect the temperature of the intake air supplied from the upstream side and an air flow meter 18 to detect the amount of intake air are arranged in the intake passage 6 between the air cleaner 4 and the throttle valve 8. A throttle sensor 20 to detect the open or closed state of the throttle valve 8 is coupled to the valve 8. An injector 22 is attached to the intake passage 6 downstream of the throttle valve 8. A surge tank 24 is provided in the intake passage 6 between the injector 22 and the throttle valve 8. A bypass passage 26 communicates with the surge tank 24 and bypasses the incoming air around the throttle valve 8 when the engine temperature is low. An air valve 28 is provided in the bypass passage 26. A coolant temperature sensor 30 to detect the temperature of cooling water or coolant is attached to a passage for coolant of the engine 10.

The fuel injection control apparatus 2 has a control section or control unit 32. The intake air temperature sensor 16, air flow meter 18, throttle sensor 20, coolant temperature sensor 30, and ignition device 14 are connected to the control section 32. In addition, a starter signal detecting section 34 which detects that the engine is being started, a vehicle velocity sensor 36 which detects the velocity of the vehicle, and a battery 38 are coupled to the control section 32. The velocity sensor 36 may be a part of the axle system, speedometer cable system, or distance integrating indicator system in the instrument panel. The detecting section of the velocity sensor 36 may be a detecting mechanism of the photoelectric type, electromagnetic type or electric contact type. Further, the output signal of the velocity sensor 36, namely the signal indicative of the velocity of the vehicle, may be an analog signal which is proportional or inversely proportional to speed, or it may be a digital signal or a pulse signal.

The control section 32 will now be explained in detail with reference to FIG. 3. The control section 32 includes a CPU (Central Processing Unit) 40 which processes the signals from the various sensors and performs calculations to determine an injection signal for controlling the injector 22; an I/O interface circuit 42 serving as an input/output circuit for the input signals from the various sensors and the output signal to the injector 22; a RAM (Random Access Memory) 44 to temporarily store arithmetic operation data or the like in the CPU 40; a ROM (Read Only Memory) 46 to store a control program and/or various kinds of constants; and a power supply circuit 48.

The control section 32 contains a predetermined rotating speed ($N_u$) for the engine and compares the actual rotating speed ($N_e$) of the engine detected by the ignition device 14 with the predetermined rotating speed ($N_u$). The control section 32 also contains a predetermined velocity ($V_u$) for the vehicle and compares the actual vehicle velocity (V) detected by the velocity sensor 36 with the predetermined velocity ($V_u$). Asynchronous fuel injection control is performed independently of the ordinary fuel injection scheme in the case where the following three conditions are satisfied: (1) the idle contact of the throttle sensor 20 is switched from ON to OFF, (2) the rotating speed ($N_e$) of the engine is higher than the predetermined rotating speed ($N_u$), and (3) the vehicle velocity (V) is higher than the predetermined velocity ($V_u$).

The operation of the invention will now be explained with reference to the flowchart of FIG. 4. First, the engine is started as the initial step for driving the vehicle (in step 100). A check is then made to see if the idle contact of the throttle sensor 20 is switched from ON to OFF (in step 102). In other words, in step 102 it is determined whether the engine has shifted from the idling operating state to the running operating state. If not, asynchronous correction control to increase the amount of fuel injected is not performed, but instead fuel injection control in the ordinary and conventional manner is carried out (in step 110). On the other hand, if it is determined in step 102 that the idle contact has switched from ON to OFF, a check is made at 104 to see if the rotating speed of the engine ($N_e$) detected by the ignition device 14 is higher than the predetermined rotating speed ($N_u$). If not, namely when the speed ($N_e$) is equal to or less than the speed ($N_u$), asynchronous correction control to increase the amount of fuel injected is not performed, but instead fuel injection control in the ordinary manner is performed (in step 110). On the other hand, if it is determined in step 104 that the actual engine speed ($N_e$) is greater than the predetermined speed ($N_u$), a further check is made at 106 to see if the vehicle velocity (V) detected by the velocity sensor 36 is higher than the predetermined vehicle velocity ($V_u$). If not, namely if the actual velocity (V) is equal to or less than the predetermined velocity ($V_u$), the processing routine advances to step 110 and fuel injection control in the ordinary manner is performed at 110 without executing asynchronous correction control. On the other hand if it is determined at step 106 that the actual velocity (V) is higher than the predetermined velocity ($V_u$), asynchronous correction control to increase the amount of fuel injected is performed in step 108. Then, the processing routine is returned to step 102 to check whether the idle contact of the throttle sensor 20 is switched from ON to OFF.

By way of this inventive fuel injection control method, asynchronous correction control to increase the amount of fuel injected is not performed in the operating state of the engine in which the vehicle velocity is very low at the start of the vehicle, thereby avoiding the production of a rich air-fuel mixture. Thus, an unnecessarily large explosion pressure in the combustion chamber is prevented and the vehicle can be stably run and no unpleasant feeling is given to the driver. In particular, when applying the fuel injection control apparatus 2 of the present invention to small-sized and light-weight vehicles, vehicles having a small cylinder capacity, front wheel drive vehicles, and the like, it is possible to prevent the occurrence of shock and the like which exerts an adverse influence on operating efficiency, so that a pleasant operating state is secured and the operating performance is improved. In addition, in the case of frequent use of the accelerator, which is pressed little by little or the like, it is possible to prevent problems such as the engine stopping, the spark plug becoming fouled and damaged, and the like.

As described above in detail, according to the present invention a check of the condition of the velocity signal is added to the normal control method for asynchronous correction, and asynchronous correction control is not performed when the vehicle velocity is very low, for example at the start of the vehicle or the like, but instead fuel injection control in the ordinary manner is carried out. Thus, particularly in case of small-sized and light-weight vehicles, vehicles having a small cylinder capacity, front wheel drive vehicles, and so forth, an unnecessarily large explosion pressure in the combustion chamber is prevented in the transient state at the start of the vehicle or the like, and problems such as shock and the like are prevented. Also, a pleasant operating state is secured and the operating performance is improved.

Also, in the case of frequent use of the accelerator, which for example is pressed little by little or the like, it is possible to prevent problems such as the engine stopping due to a bad condition of the engine, and to reduce the problems such as the spark plug being fouled and damaged or the like.

What is claimed is:

1. A method of fuel injection control for electronically controlling an amount of fuel injected into an internal combustion engine provided in a vehicle, including the step of performing asynchronous fuel injection in the case where at least the following three conditions are satisfied:

(1) the engine has shifted from an idling operating state to a running operating state;

(2) the rotating speed of the engine is higher than a predetermined rotating speed; and (3) the velocity of the vehicle is higher than a predetermined velocity.

2. A fuel injection control method according to claim 1, including the steps of detecting a shift from the idling operating state of the engine to the running operating state by checking whether an idle contact of a throttle sensor is switched from ON to OFF, detecting the rotating speed of the engine by monitoring an ignition device, and detecting the velocity of the vehicle using a vehicle velocity sensor.

3. A method of fuel injection for controlling an amount of fuel injected into a fuel-injected internal combustion engine provided in a vehicle, comprising the steps of: monitoring whether the engine is in an idling operating state, monitoring whether the rotating speed of the engine is greater than a predetermined speed, monitoring whether the velocity of the vehicle is greater than a predetermined velocity, and performing asynchronous fuel injection when all of the following conditions exist: the engine is in an operating state other than said idling operating state, the rotating speed of the engine is greater than said predetermined speed, and the velocity of said vehicle is greater than said predetermined velocity.

* * * * *